United States Patent [19]

Stormon

[11] 4,099,579

[45] Jul. 11, 1978

[54] DRILL MOUNTING DEVICE FOR BACKHOE ATTACHMENTS

[76] Inventor: Harry J. Stormon, 908 Camino Real, Sparks, Nev. 89431

[21] Appl. No.: 766,937

[22] Filed: Feb. 9, 1977

[51] Int. Cl.[2] ..... B23Q 5/00

[52] U.S. Cl. ..... 173/4; 173/28; 173/31

[58] Field of Search ..... 173/4, 5, 6, 7, 8, 9, 173/38, 31, 147, 46, 23, 28; 408/130; 37/117.5

[56] References Cited

U.S. PATENT DOCUMENTS

| | | | |
|---|---|---|---|
| 2,969,844 | 1/1961 | Hamrick | 173/23 |
| 3,205,951 | 9/1965 | Pyles | 173/147 |
| 3,565,184 | 2/1971 | Gustafsson | 173/28 |
| 3,664,436 | 5/1972 | Beagan | 173/28 |
| 3,684,035 | 8/1972 | Wills | 173/147 |
| 3,702,712 | 11/1972 | Cairns | 37/117.5 |
| 3,915,501 | 10/1975 | Cobb et al. | 37/117.5 |

*Primary Examiner*—Robert A. Hafer

*Attorney, Agent, or Firm*—James R. Cypher

[57] ABSTRACT

A device for mounting a hand operated drill such as a rotary or sinker drill on a backhoe attachment for tractors and trucks including a slide mounted tool carrier attached to a roller chain loop mounted on a mast assembly. The mast assembly is either removably mounted on the bucket of the backhoe attachment or to the bucket linkage.

High cycle oscillation is dampened by a shock absorber booster spring assembly.

The spring assembly may also be used in combination with a fluid control valve mechanism to automatically adjust the drilling and vance.

A trunnion assembly may be provided to increase the positionability of the mounting device.

A flow control valve connected to the spring assembly automatically maintains constant thrust values to the drill.

7 Claims, 9 Drawing Figures

DRILL MOUNTING DEVICE FOR BACKHOE ATTACHMENTS

BACKGROUND OF THE INVENTION

A vast equipment gap exists in the mining and construction industries between the tools for manual operation of pneumatic and hydraulic actuated rotary and percussion drilling tools and; the extremely large, complex and expensive machines designed for drilling blast holes, exploration holes, anchor holes and the like in rock and other hard cemented materials or through frozen earth.

Operating the widely used hand-held sinker or rotary drill for these necessary purposes is a dirty, dangerous and exhausting experience that results in gross manpower inefficiency in any more or less continuing mining or construction demolition task. Usually these hand-held tools, including steel drill rods, bits, fluid hoses and fittings gross close to one-hundred pounds and are near the maximum weight that can be manipulated manually, even on downward drilling. Further, in practice, most required drill hole depths are greater than the normal two-foot length attainable manually before changing to longer drill rods. The operator's physical endurance is additionally taxed by then having to unlatch the drill rod, replace it in the hole with the next longer two-foot increment length, lift, relatch and proceed sequence.

Certainly not the least consideration is the danger to the operator in trying to maintain secure footing under conditions of maximum physical exertion. Often in manual operation, footing is precarious, on broken ground, temporary scaffolds, down in a trench, or other adverse conditions.

At the other end of the spectrum are the huge, bulky, heavy, minimum mobility specialty drilling machines which are normally beyond the financial means of the miner or contractor for the usual intermittent tasks.

SUMMARY OF THE INVENTION

The gist of this invention is to provide a carrier for mounting the normally hand-held existing sinker drill tool to a mechanized extendable mast which in turn attaches to the bucket or bucket linkage of the ubiquitous backhoe attachment. This accomplishes the mechanization of the previously manual operation but leaves the normally hand-held tool unaltered and immediately removable for utilization manually where limitations in access do not permit a portion of the required task to be accomplished by the mechanized mode.

The primary object of the invention is to provide a practical device for mounting a normally hand-held rock sinker drill, or similar drills, to a mechanized mast and thence to a hydraulic powered backhoe attachment. This will permit the drill tool to be manipulated by mechanical power thereby improving the efficiency and utilization of the tool, however, leaving the tool unaltered so it can be quickly removed and used manually, if required by limited access in some part of the task.

Another objective is to accomplish the above by such means that the safety of the operator is greatly enhanced and protection of the tool from damage due to misoperation is provided.

DESCRIPTION OF THE PREFERRED EMBODIMENTS

Figure 1:
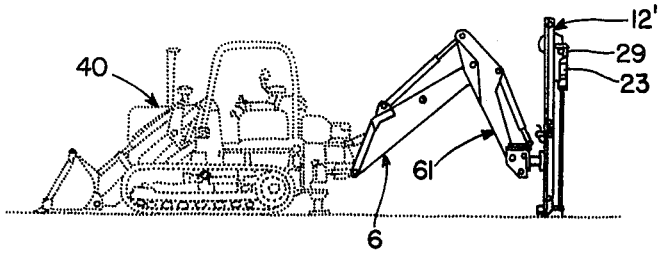
FIG. 1 is a side elevation view of the mounting device of the present invention connected to a backhoe attachment mounted on a tractor.
Figure 2:
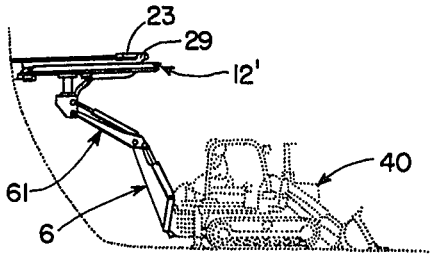
FIG. 2 illustrates the use of the attachment of FIG. 1 for drilling holes in a wall.
Figure 3:
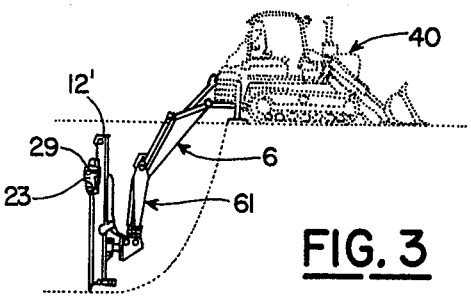
FIG. 3 illustrates the use of the attachment of FIG. 1 for drilling holes at an elevation below the tractor.
Figure 4:
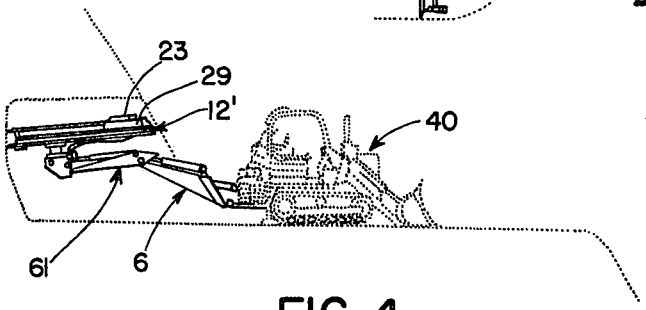
FIG. 4 illustrates the use of the attachment of FIG. 1 in drilling within a tunnel.
Figure 5:
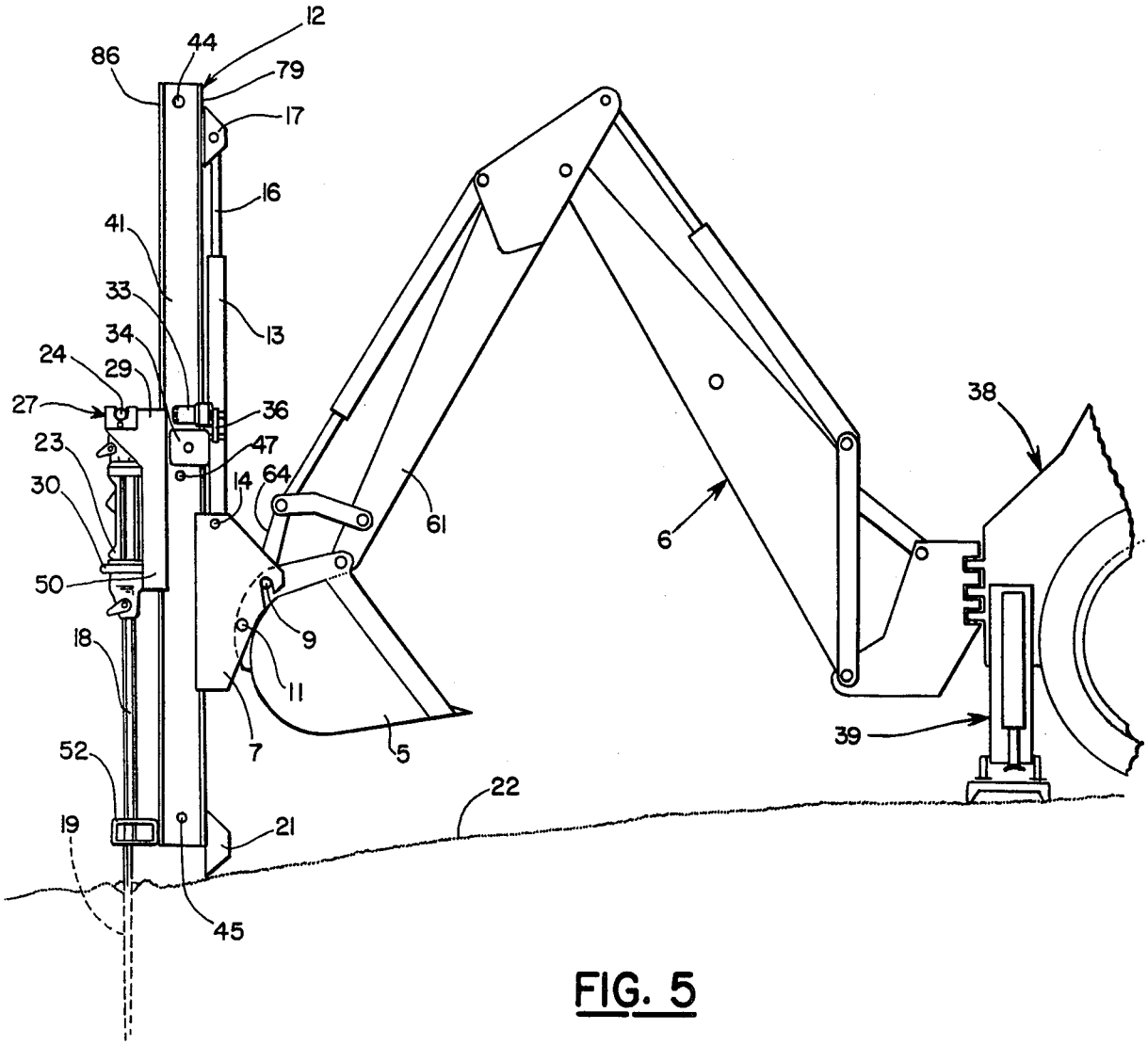
FIG. 5 is a side elevation view on an enlarged scale of a modified form of the invention with the attachment mounted directly to the bucket of the backhoe attachment.

FIG. 5 shows the mounting device of the present invention firmly fixed to the bucket 5 of the backhoe attachment 6 by its attach plates 7 and 8 installed on the over-length wrist linkage pin 9 and the pin 11, furnished, through the power digging position holes of the bucket. The slide mounted tool carrier drive mast assembly 12 is advanced or retracted by the hydraulic cylinder 13 anchored to the fixed attach plates by pin 14 and drives piston 16 attached to the mast travelling anchor 17. This feature is required to assure accurate spotting of the drill rod 18 at the target location of the hole 19 to be drilled, then advancing the mast so that the foot 21 is firmly in contact with the ground 21. The normally hand-held pneumatic or hydraulic actuated rock sinker drill 23 or a rotary drill is installed through its handles 24 and 25, through latches 27 and 28, into the slide mounted tool carrier 29 and held in alignment by a wrap-around coil tension spring 30 enclosed in a section of rubber hose. The tool carrier is advanced to drill the object hole, and subsequently retracted, through its attachment to the roller chain drive loop 32 in the mast assembly. This drive loop is powered by the reversible fluid driven motor 33 through the v-belt driven worm gear speed reducer 34. An adjustment for the tension in the V-belt 36 acts to limit the torque on the chain drive sprocket 37 to prevent an over-thrust condition to the carrier and drill. The controls for these functions are mounted with the backhoe controls at the operator's position.

Figure 6:
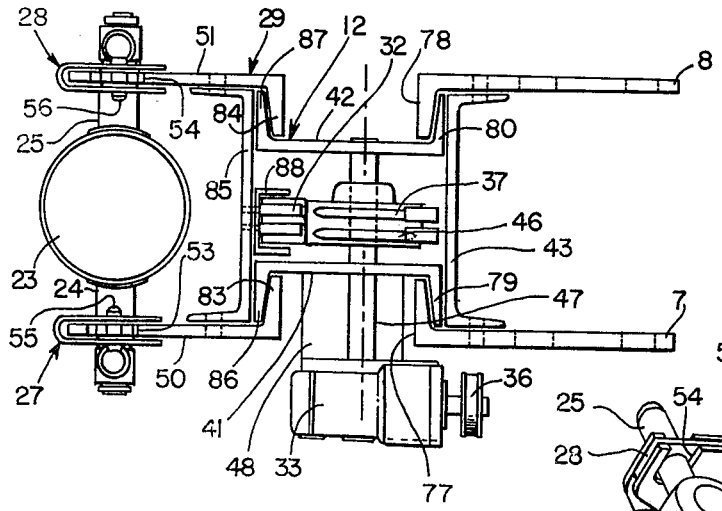
FIG. 6 is a top plan view of the attachment shown in FIG. 5.

Referring to FIGS. 5 and 6, the backhoe attachment is connected to a wheeled tractor 38 with outriggers 39 in place to steady the equipment during the drilling operation. Crawler tractors 40 as illustrated in FIGS. 1 – 4 are also commonly fitted with backhoe attachments.

The mast assembly may be constructed in various ways. As illustrated, a pair of back to back channels 41 and 42 are joined to channel 43 which is in turn connected to attach plates 7 and 8. Idler sprockets are mounted on the mast by pins 44 and 45. The chain drive may be driven by a pair of sprockets 37 and 46 attached to drive shaft 47 driven by the speed reducer and motor assembly which are mounted on the mast by bracket assembly 48.

The tool carrier 29 may be constructed from a pair of angle members 50 and 51 formed with cradle cutouts 53 and 54 for receiving handles 24 and 25 of the sinker drill tool. The U-shaped latches 27 and 28 cooperate with pull shear pins 55 and 56 to quickly and easily engage and disengage the handles of the tool. A guide 52 connected to the base of the mast guides the drill 18.

Figure 7:
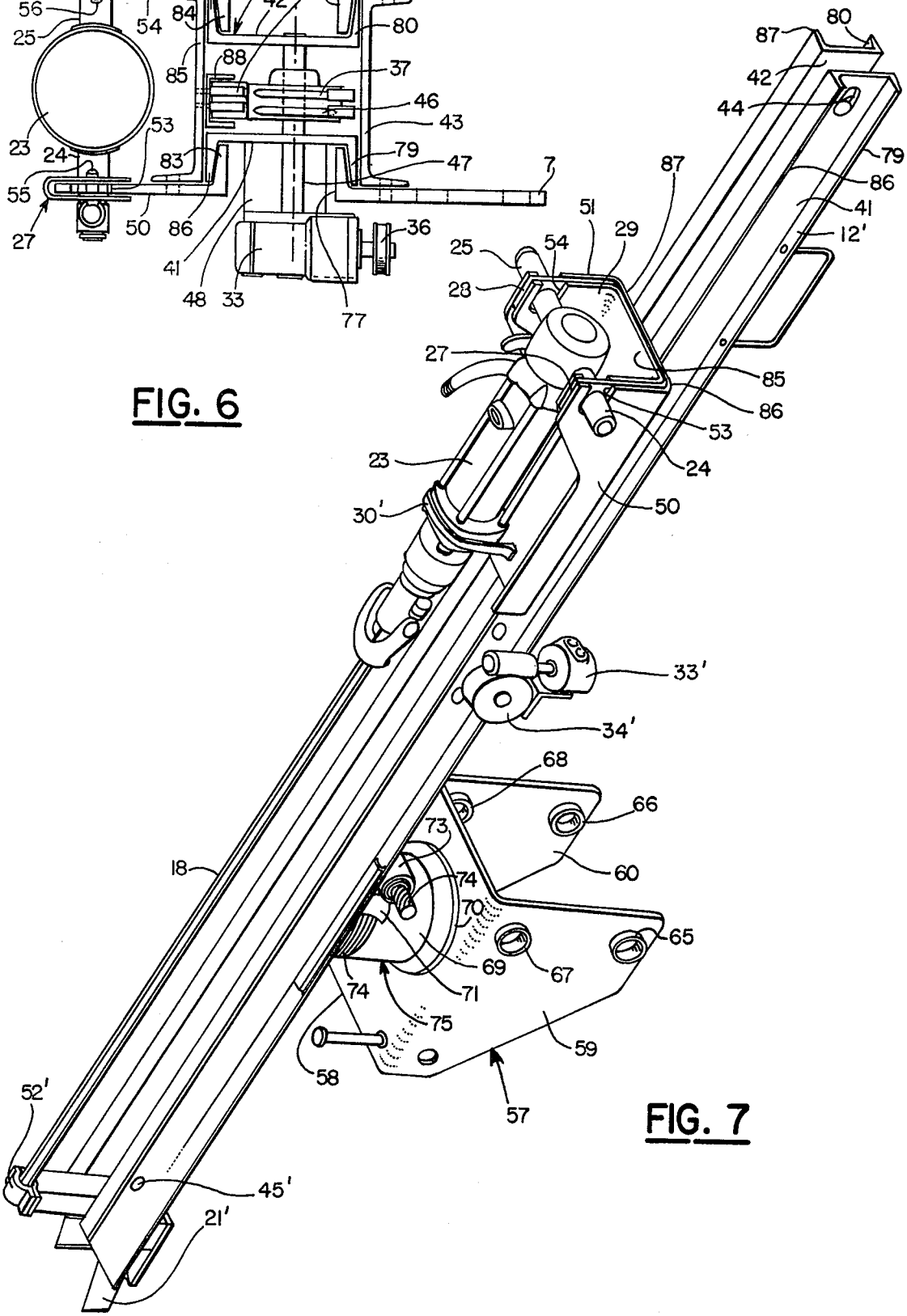
FIG. 7 is a perspective view of an enlarged scale of the attachment shown in FIG. 1.
Figure 8:
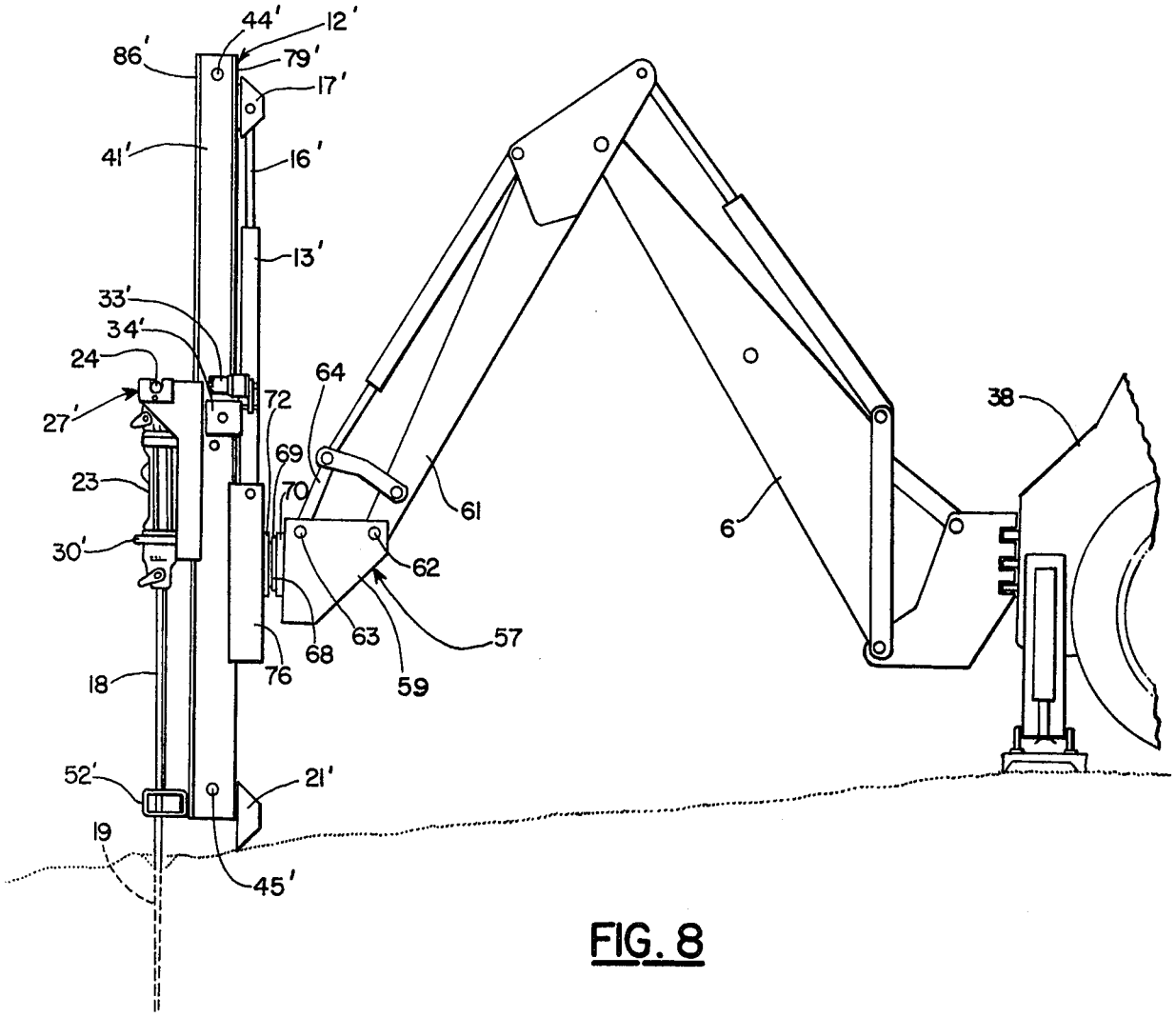
FIG. 8 is a side elevation view of the attachment shown in FIGS. 1 and 7.

FIGS. 7 and 8 illustrate an alternative configuration attach method available where the backhoe bucket is dropped by removing its two attaching pins. The attach link 57 which consists of a U-shaped member having a base 58 and side members 59 and 60 is then joined to the dipper stick 61 and wrist link 64 by reinstalling pin 63 through openings 67 and 68 and by installing pin 62 furnished, through the aft holes 65 and 66 of the link 67. A trunnion assembly 75 is available to permit the mast to be swung left or right out of the normally vertical plane if the user's specific needs should require.

The trunnion assembly may be constructed in various ways. One method is to weld a heavy wall pipe 69 with an integral flange 70 to the base 58 of the attach link 57. Another heavy wall pipe 71 with a larger outside diameter fits around pipe 69 and is formed with an integral flange 72 connected to the mast assembly. A brass ring placed between the pipes provides the necessary bearing. The mast may be turned at various angles by providing a typical worm gear driving assembly 73 with a crank 74 or other drive means which engages a ring gear 74 attached to pipe 69.

The mast mounting slide guide 76 corresponds to the attach plates 7 and 8 shown in FIG. 5 except that a backing plate is added to accommodate its attachment to the flange 72 of the swing trunnion 75 in FIGS. 7 and 8. All other features and functions remain unchanged from that shown and described in FIG. 5 and like parts are designated by the same numbers with the addition of the prime (') symbol.

As shown in FIG. 6, flanges 77 and 78 of the bucket attach plates 7 and 8 and channel 43 cradle flanges 79 and 80 of steel channels 41 and 42 so that they form the slide enclosure for the mast channels. This permits the mast to be advanced or retracted by the hydraulic cylinder 13 as shown in FIG. 5. Similarly, flanges 83 and 84 of the tool carrier and channel 85 are joined so as to form the slide enclosure over the other flanges 86 and 87 of the mast channels 41 and 42. This permits the tool carrier assembly to be advanced or retracted on the mast through its attachment to the roller chain drive loop 32 by attachment 88 powered by the sprocket fixed to the drive shaft 47 of the worm gear reducer 34 driven through the torque limiting v-belt or chain drive 36 by the fluid motor 33. The rock sinker drill tool 23 is attached to the carrier by having its handles 24 and 25 attached through the latches 27 and 28 by the safety shear pins 52 and 53 and thus advances for drilling or retracts with the carrier.

Figure 9:
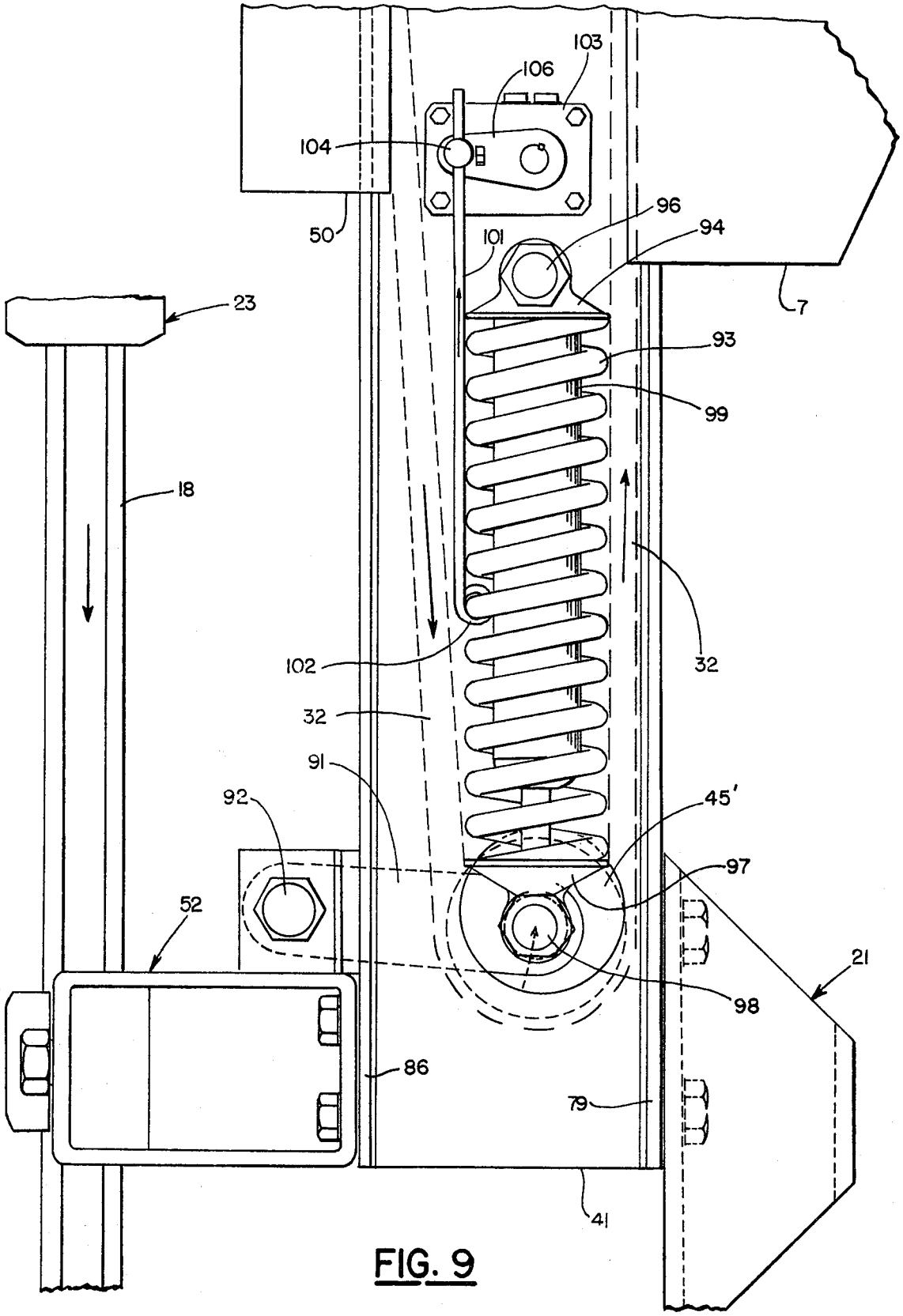
FIG. 9 is a partial side elevation view of a modified form of the invention.

FIG. 9 illustrates the drill uniform thrust control device which senses the resistance-to-drilling changes in non-uniform ground and rock, and converts that sensed change to an automatically adjusted flow of hydraulic fluid through the chain loop drive motor.

As ground conditions change which increase the resistance fo the advancement of the drill, the drilling rate must be slowed accordingly. Such resistance increases the tension on the chain loop. This tension raises the chain idler sprocket 45' which is supported by arm 91 which is anchored at and pivots about pin 92. This raising action is resisted and the high cycle oscillation absorbed by compression spring 93 which is mounted between spring retainer 94 attached to the mast by pin 96 and spring retainer 97 attached to lever arm 91 by pin 98 and is boosted by pneumatic shock absorber 99 mounted within the spring and connected at pins 96 and 98.

The high cycle oscillation effects having been dampened out in the lower part of the shock absorber booster springs, the control rod 101 connected to spring 93 at loop 102 is raised more or less uniformly by being attached to the upper area of one of the booster springs. This movement of the control rod upward is translated into closing down the flow of the motor driving hydraulic fluid permitted through flow control valve 103 by its attachment at pin 104 to lever arm 106.

Flow control valve 103 is a standard volume flow control valve such as those made by Vickers and is suitably connected to the hydraulic motor 33 by pressure hoses.

Conversely, as the drilling resistance decreases and the chain tension decreases, the shock absorber booster spring reextends thereby increasing the flow rate to the hydraulic motor. This maintains fairly constant thrust values to the drill by varying the speed of the advance and, it also absorbs much of the inherent shock before it reaches the chain loop drive mechanism.

I claim:

1. A drill mounting device for backhoe attachments comprising:

a. attachment means removably affixed to the end of said backhoe and formed with a slide rail;

b. an elongated mast slidably mounted on said attachment means and formed with a slide rail;

c. power means connected to said attachment means and said mast for controlled lowering and raising of said mast;

d. a tool carrier slidably mounted on said mast slide rail and formed with a handle holding member adapted for removably holding the handle portion of said drill;

e. a chain loop mounted on said mast and connected to said carrier;

f. motor means operably connected to said chain loop for movement thereof;

g. a pair of latch members slidably mounted on said tool carrier and adapted for engaging the handles of said sinker drill; and h. a pair of shear pins connected to said carrier and to said latches which are dimensioned to shear and release said drill from said carrier when the force exerted on said drill exceeds a preselected force.

2. A device as described in claim 1 comprising:

a. said attachment means includes a pair of attach plate members adapted for connection to the bucket of said backhoe attachment by removable pins.

3. A device as described in claim 1 comprising:

a. said attachment means includes an attach link adapted for connection to the dipper stick and wrist linkage by removable pins.

4. A device as described in claim 3 comprising:

a. said attachment means includes a trunnion member interposed between said attach link and said mast for permitting rotation of said mast about a horizontal axis.

5. A device as described in claim 1 comprising:

a. mounting means carrying said chain loop including a movable idler sprocket permitting tensioning and slackening of said chain loop; and b. spring means biasing said idler sprocket to a tensioned position.

6. A device as described in claim 5 comprising:

a. hydraulic motor means operably connected to said drill tool;

b. a flow control valve operably connected to said hydraulic motor means for varying the flow of fluid to said motor; and c. control means connected to said flow control valve and operably connected to said chain loop for controlling said flow control valve as a direct response to the tension in said chain.

7. A device as described in claim 6 comprising:

a. said control means includes an elongated rod connected to a lever of said flow control valve and to said spring means.

* * * * *